US006418645B1

(12) United States Patent
Hammerle et al.

(10) Patent No.: US 6,418,645 B1
(45) Date of Patent: Jul. 16, 2002

(54) MILLING UNIT FOR THE BEATING OF SNOW-COVERED SLOPES

(75) Inventors: Ulrich Hammerle, Arlberg (AT); Hermann Rainer, Vipiteno (IT)

(73) Assignee: Leitner S.p.A., Vipiteno (IT)

( * ) Notice: Subject to any disclaimer, the term of this patent is extended or adjusted under 35 U.S.C. 154(b) by 0 days.

(21) Appl. No.: 09/662,129

(22) Filed: Sep. 14, 2000

(30) Foreign Application Priority Data

Sep. 15, 1999 (IT) ..... MI99A1920

(51) Int. Cl.[7] ..... E01H 4/00; A01B 33/16

(52) U.S. Cl. ..... 37/222; 172/72

(58) Field of Search ..... 37/221, 222, 223, 37/196, 258, DIG. 8, 197; 172/72, 112, 117, 310, 311, 123; 414/569

(56) References Cited

U.S. PATENT DOCUMENTS 4,359,831 A * 11/1982 Beeley ..... 37/258
4,892,154 A * 1/1990 Ranner ..... 172/72
5,067,264 A * 11/1991 Beeley ..... 37/222
5,680,715 A * 10/1997 Thiboutot et al. ..... 37/219
5,765,782 A * 6/1998 De Vetter ..... 242/403

* cited by examiner

*Primary Examiner*—Robert E. Pezzuto
(74) *Attorney, Agent, or Firm*—Oblon, Spivak, McClelland, Maier & Neustadt, P.C.

(57) ABSTRACT

A milling unit for the beating of snow-covered slopes consisting of a box-shaped structure comprising a central part to which two side parts are connected by hinging elements, in order to allow for oscillation. The structure has two hooking elements for its connection to a tool-holder, in turn connected to a rear part of the vehicle and, on the opposite side the structure has a rake for the beating of the snow. Inside each of the side portions of the structure there is a side miller and within the central structure there is a central miller, where the side millers can be activated in rotation by at least one motor, and each one of them is connected to the central miller by a constant-velocity transmission. The hinging axles do not pass through the axles of the central and the side millers.

13 Claims, 6 Drawing Sheets

MILLING UNIT FOR THE BEATING OF SNOW-COVERED SLOPES

BACKGROUND OF THE INVENTION

1. Field of the Invention

The present invention refers to a milling unit for the beating of snow-covered slopes.

When it snows and the snow settles on the ground a problem arises related to the preparation of the ski slopes to make them sufficiently compact so that even inexperienced skiers can move around safely.

This is normally carried out by using milling units that are connected, using suitable tool-holders, to the rear part of a hauling vehicle. The milling unit crushes the snow and subsequently beats it, in order to create a compact and uniform layer of snow which is fixed to the ground.

2. Discussion of the Background

The traditional milling units consist of a structure normally comprising three elements which are all hinged together, in order to be able to adapt to the unevenness of the ground. Within the structure there are normally three mills, in correspondence with each one of the three elements of the structure. The miller consists of two side toothed cylinders contained within two side elements of the structure, supported at one end by side walls of the structure and each one connected to a hydraulic motor for its activation. The other end of the side cylinders is supported by loops which are integral with the structure of the unit.

Furthermore, these two ends of the side millers are connected by joints articulated to a central miller, also consisting of a toothed cylinder, contained within the central element of the structure of the group.

Within traditional milling units, the axles of the millers and the axles of the connection hinges between the three elements forming the structure merge and, more precisely, cross over the articulated connection joints between the three millers of the unit.

Such a structure prevents the sliding of the snow within the structure. This causes vibrations and a high resistance to advancement of the unit; naturally this affects the reliability and duration of the traditional milling unit.

Furthermore, it has been found that the outflow of the snow between the coupling elements of the hinged elements of the structure that can mutually oscillate does not occur correctly. This is therefore reason for the irregularities on the snow-covered slopes which could turn out to be dangerous for skiers.

Therefore the demand to simplify the structure of the milling units for the beating of well-known snow-covered slopes exists, making them in keeping with the requests of operators from a technical and functional point of view.

SUMMARY OF THE INVENTION

The objective of the present invention is, therefore, that of eliminating the technical problems reported, by creating a milling unit for the beating of snow-covered slopes which is very reliable and with a long duration, in terms of years.

Another objective of the invention is that of creating a milling unit which, during operation, does not cause vibrations and/or does not exert high resistance to the advancement of the hauling vehicle.

A further objective of the invention is that of creating a milling unit which can guarantee a correct outflow of snow between the coupling elements of the hinged elements of the structure.

One more objective of the invention is that of creating a milling unit which creates substantially safe slopes, for skiers with average skills.

Last but not least, another objective of the invention is that of creating a milling unit for the beating of snow-covered slopes that is substantially simple, safe and economic.

These and other objectives, according to the present invention, are achieved by creating a milling unit for the beating of snow-covered slopes according to claim 1.

Furthermore, other features of the present invention are defined in the following claims.

BRIEF DESCRIPTION OF THE DRAWINGS

Further features and advantages of a milling unit for the beating of snow-covered mountains according to the present invention will become more clear from the following description, exemplificative and not limitative, which refers to the attached drawings, in which.

DETAILED DISCUSSION OF THE PREFERRED EMBODIMENTS

Figure 1:
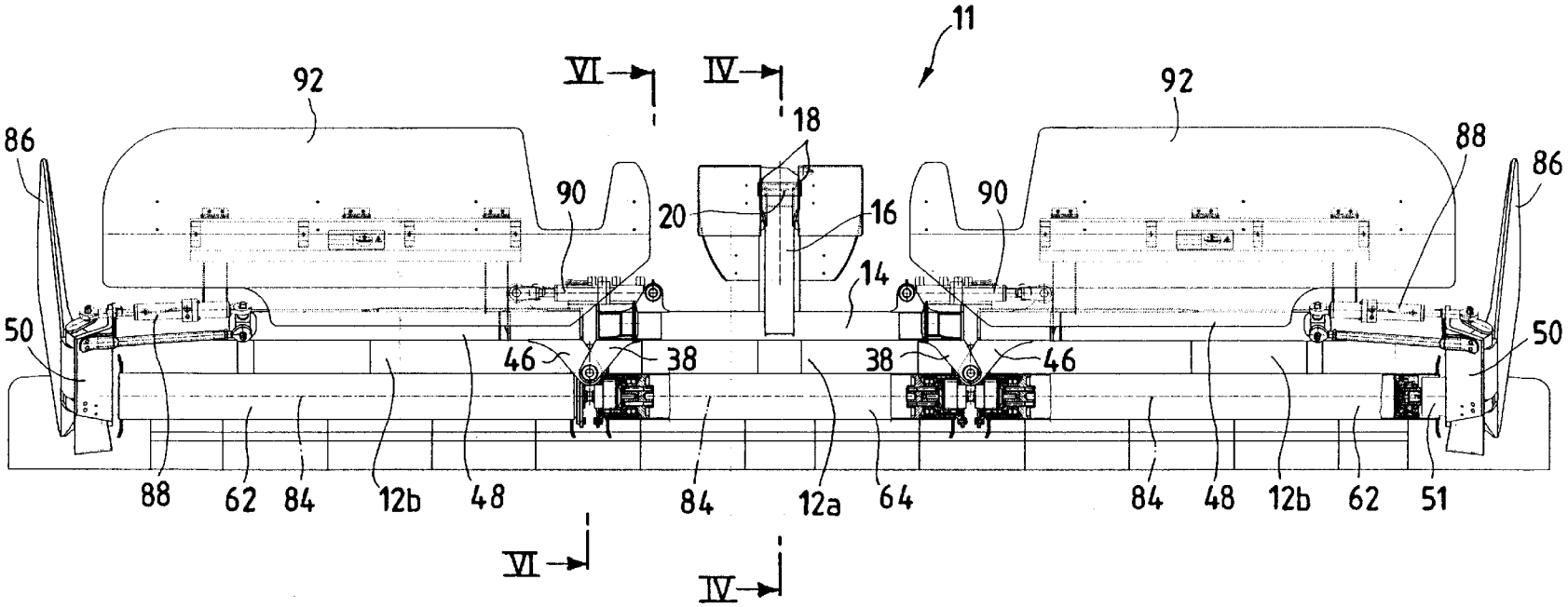
FIG. 1 illustrates in partial section a front view of a milling unit according to the present invention.
Figure 2:
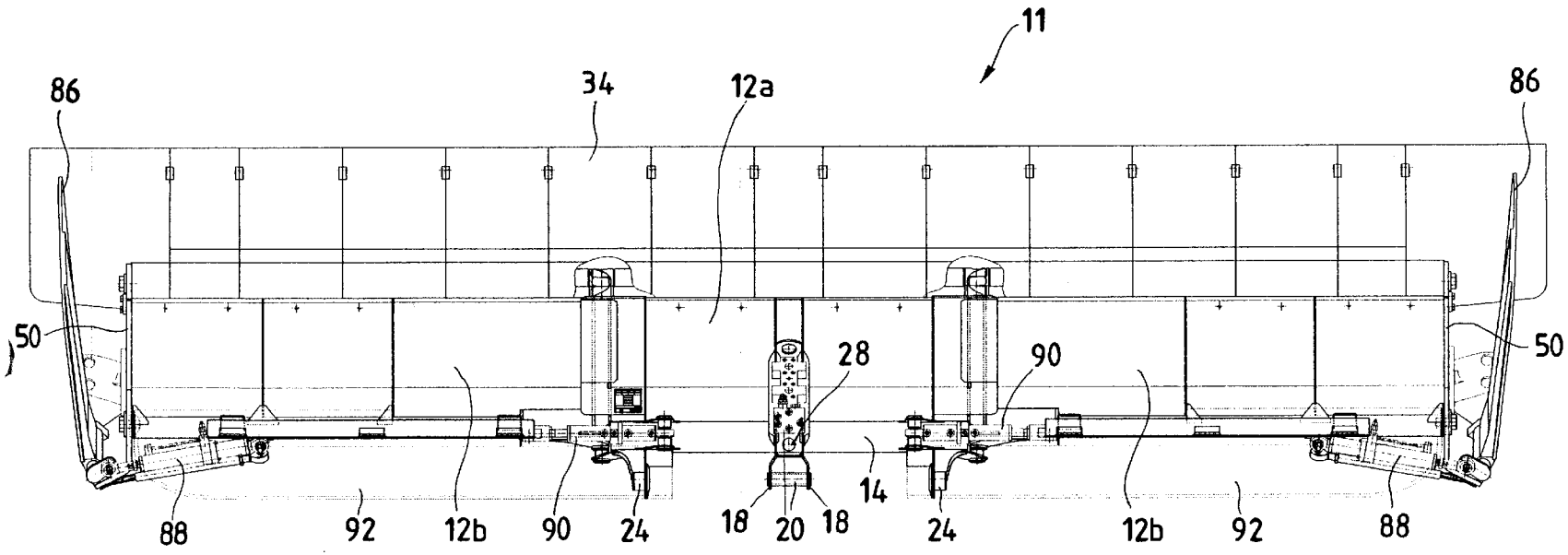
FIG. 2 illustrates a plan view from above of the milling unit of FIG. 1.
Figure 3:
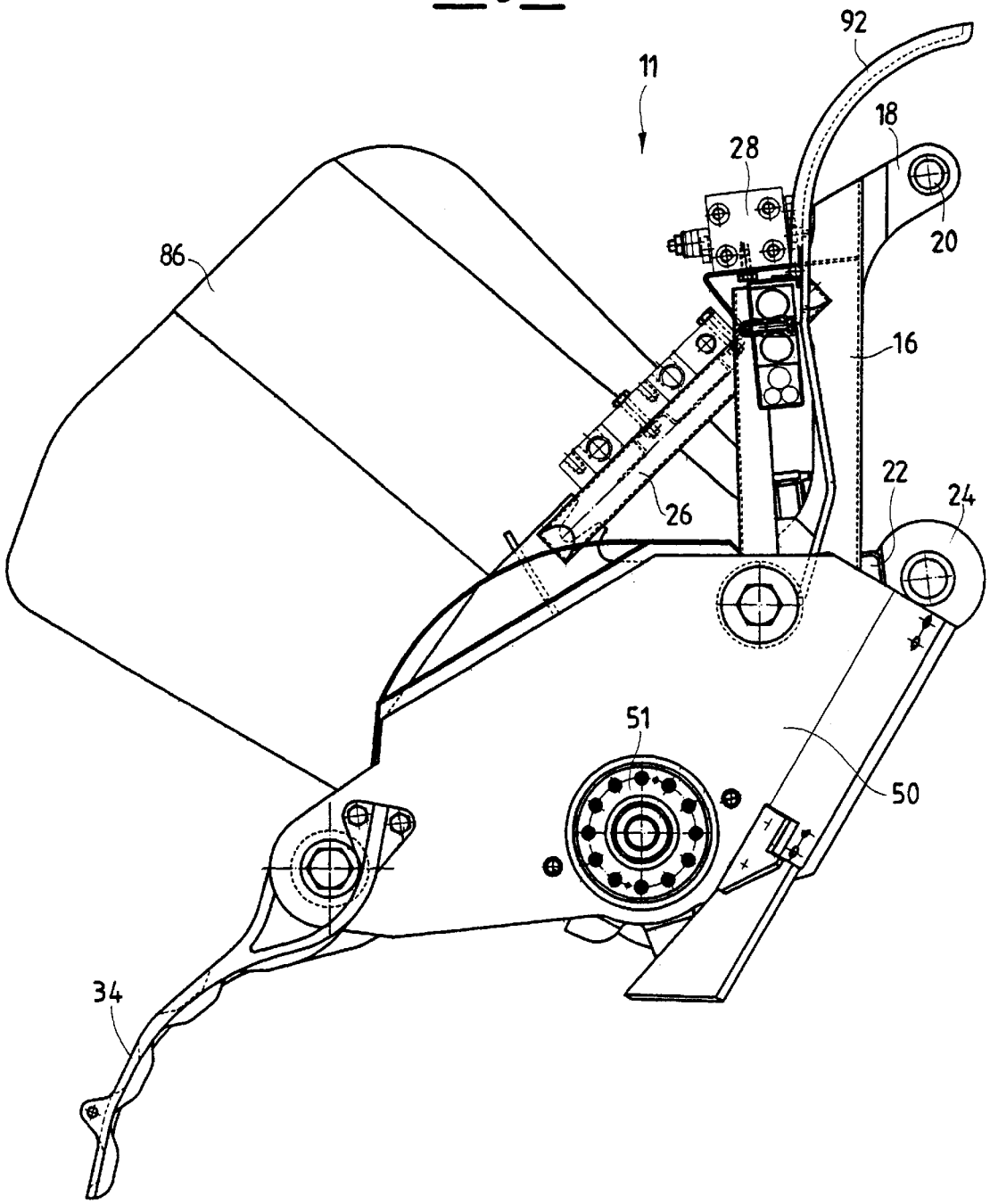
FIG. 3 illustrates an enlarged side view of the milling unit of FIG. 1.
Figure 4:
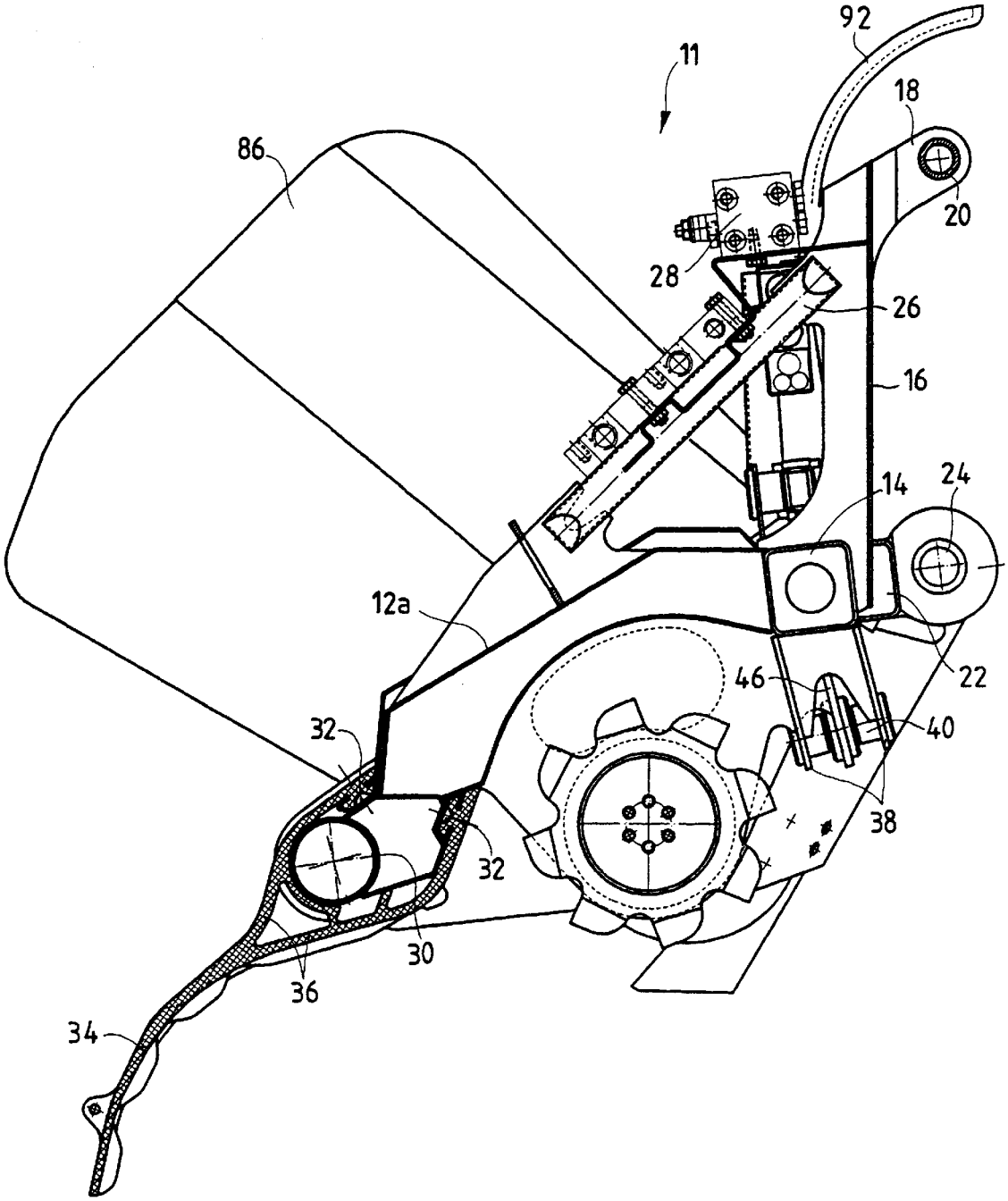
FIG. 4 illustrates an enlarged section taken along the line IV—IV of FIG. 1.
Figure 5:
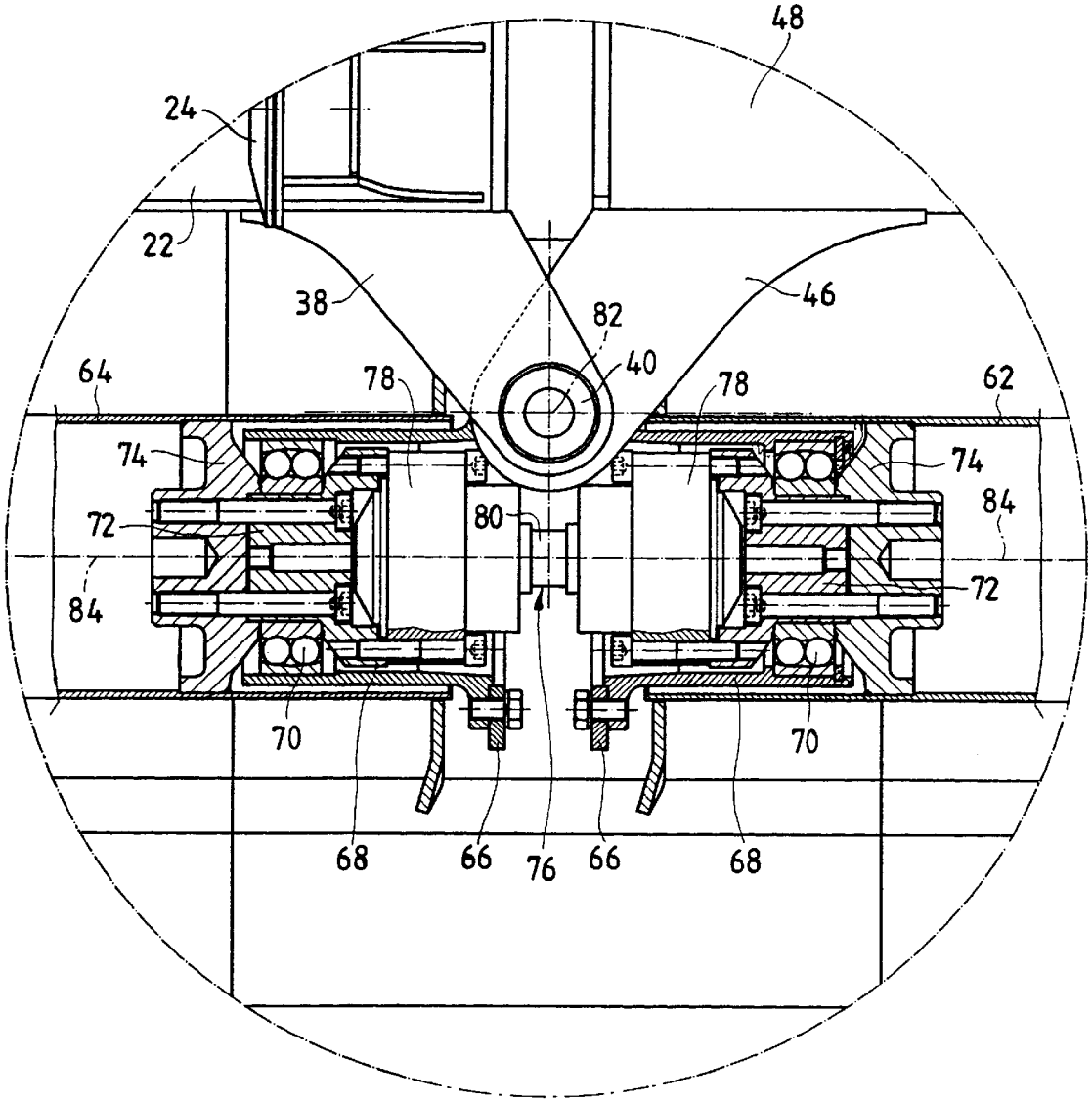
FIG. 5 illustrates an enlarged detail of FIG. 1, wherein a connection between the side miller and a central miller is represented.
Figure 6:
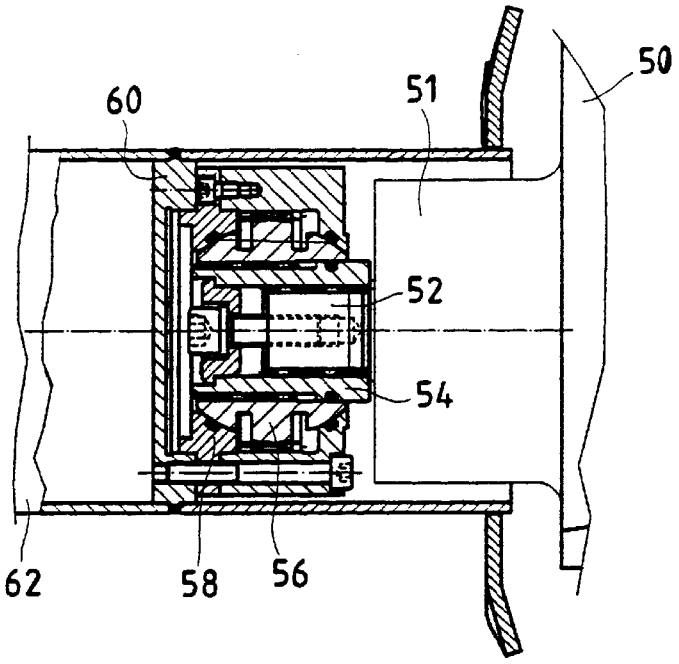
FIG. 6 illustrates a detail of FIG. 1, wherein an end portion of a side miller is represented.
Figure 7:
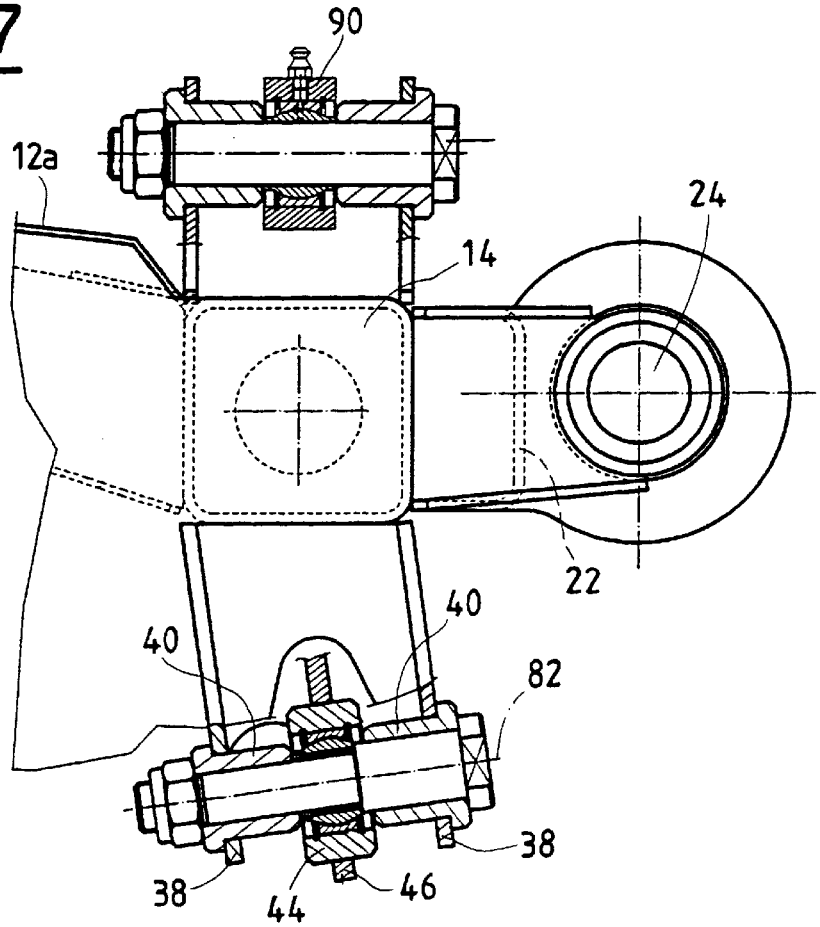
FIG. 7 illustrates an enlarged section taken along the line VII—VII of FIG. 1.

With reference to the figures indicated, a milling unit for the beating of snow-covered slopes is illustrated, indicated globally with the reference numeral 11.

The milling unit 11 includes a box-shaped structure consisting of three portions connected between themselves by hinging, in order to allow for oscillation.

A central portion 12*a* of the structure is connected to a square section tube 14 to which a bar is connected, placed substantially perpendicular to the tube 14 along a transversal symmetry axle of the same portion 12*a*. At its free end, the bar 16 has a pair of handles 18 to which a pin 20 is fixed, which constitutes a hooking element to a tool-holder, not illustrated.

However, a piece of tube 22 is fixed to each one of the two opposite ends of the tube 14 which supports, in turn, a loop 24, as a further hooking element to the tool-holder.

Between the central portion 12*a* of the structure and the bar 16 there is another bar 26 which, besides tightening the structure, creates support for an oil-pressure control unit 28, fixed to it by bolts.

The end portion 12*a* of the structure has another tube 30 and, next to this, two blocking seats 32 for the rake for the beating of the snow. The rake has a toothed working surface 34 and a forked hooking portion 36. The forked portion 36 enfolds the tube 30 and is blocked within the two seats 32.

To each one of the ends of the central portion 12*a* of the structure a side portion 12*b* is hooked. In this connection a pair of handles 38, each one with a through hole, protrudes from each end of the tube 14.

In each of these through holes a bush 40 fitted with a collar, each of which is aimed towards the outside of the pair of handles 38, is inserted. Between the bushes 40 a spherical joint connection 44 is fixed to another handle 46, which is integral with a tube 48, which forms part of one of the two side structures 12*b*. The side structures 12*b*, of a box-shaped structure, have a side wall closed by a plate 50.

Each of the plates 50 have a motor 51, normally of an oil-pressure kind, which activates in rotation a shaft 52. A bush 54 with a spherical bowl 56 is coupled to the shaft 52. This spherical bowl is placed in a seating 58, consisting of two elements and fixed to a plate 60 which, in turn, is fixed to the inside of a side miller 62 consisting of a toothed tube and placed within the side portion 12*b* of the box-shaped structure. The miller 62 extends right up to partially cover an end of the motor 51, still remaining at a distance in order to allow for the oscillation of the miller 62 itself.

The other end of each of the side millers 62 is connected in an articulated manner to a central miller 64, in turn placed within the portion 12*a* of the box-shaped structure. In particular, as illustrated in drawing 5, the adjacent end of each of the side portions 12*b* and of the central portion 12*a* each have a plate 66 to which a tube 68 is fixed. One of the tubes 68 is inserted between the side miller 62 while the other is inserted in the central miller 64, in any case both of the tubes 68 are not in contact with the two millers 62, 64 but they are spaced out.

In each tube 68 a bearing 70 is inserted which supports a sleeve 72 which is integral with a disk 74 fixed onto each one of the millers 62, 64.

On the other side, each of the sleeves 72 is fixed to a constant-velocity joint 76, preferably with rounded teeth, with two portions 78 each of which is fixed to one of the sleeves 72 and connected between themselves by a constant-velocity shaft 80.

As can be clearly seen from drawing 5, an axle 82 of the hinging between each of the side structures 12*b* and the central structure 12*a* does not pass through a corresponding axle 84 of the constant-velocity joint 76 and does not meet up with the constant-velocity shaft 80. The axles 82 and 84 in particular are slanted with regards to the axle 84 which lies above the axle 82 with the milling unit 11 correctly orientated.

At the two ends of each of the side structures 12*b* a fold-away shovel 86 is hinged, which can be opened out in order to increase the surface area to be beaten during each course.

The shovels 86 as well as the side structures 12*b* can be rotated, controlled by double action hydraulic cylinders 88, 90 activated by oil-pressure control units 28. The control unit 28 and the cylinders 88, 90 are connected by flexible tubes, not illustrated for simplicity.

Furthermore, each one of the side structures 12*b* is equipped with a snow-guard 92.

The operation of the milling unit for the beating of snow-covered slopes according to the invention is substantially the following.

The milling unit 11 is hooked to a tool-holder (not illustrated) which, in turn, is hooked to the rear part of a hauling vehicle, such as a snowcat.

In particular, the tool-holder is hooked to the loops 24 and, furthermore, one of its supports, is hooked to the pin 20.

After having started up the vehicle the millers 62, 64 can be activated and the milling unit 11 can be hauled along a slope.

At this point the millers 62, 64 crush the snow, while the work surface 34 of the rake recompacts it by creating a uniform and solid layer on the ground. These, in fact, are the conditions in which unexperienced skiers can practise skiing in a situation of substantial safety.

The tool can be used successfully in different working methods:

with supporting pressure;

in a fluctuating position;

in counter-pressure.

These operative methods can be obtained by positioning the cylinder interposed between the tool-holder and the rear part of the vehicle in a different way, and acting on the cylinders 90.

Furthermore, the cylinders 90 allow for the adaptation of the pressure put on the snow by the side portions 12*b* of the structure of the milling unit 11, making it compatible with the pressure of the central portion 12*a*. The latter is regulated by the cylinder placed between the tool-holder and the rear part of the vehicle.

The snow transported behaves differently according to the position of the side millers with regards to the ground. In fact, due to the geometry of the orientable axles (above the centre of the miller with an angle of incidence against the running direction), by orienting the side structures downwards the snow is transported towards the centre of the snowcats, however, by orienting the side structures upwards the snow is transported to the external part of the snowcat. This effect is due to the angle of incidence and, therefore, even to the cutting angle.

Furthermore, the hydraulic circuit of the milling unit 11 according to the present invention permits, through the use of cylinders 90, the blocking of the side portions 12*b* of the structure with regards to the central portion 12*a*, so that they cannot be moved above the axle of the same central portion 12*a*. In this way the driver can use the milling unit according to the invention as a rigid unit, for example to flatten undesired humps.

We have practically established how the milling unit for the beating of snow-covered slopes according to the invention is particularly advantageous as it allows for a good flow and a very efficient running of the snow, this affects the features of reliability and durability of the milling unit. Furthermore, the outflow of the snow in the joints placed between the central portion and the two side portions of the structure has been remarkably improved.

The milling unit for the beating of snow-covered slopes conceived in this way may be subject to numerous modifications and variations, all of which are included within the scope of the invention; furthermore, all of the details can be replaced by technically equivalent elements.

In practice, the materials used, as well as the dimensions, can be any whatsoever according to technical requirements.

What is claimed is:

1. A milling unit for the beating of snow-covered slopes including a box-shaped structure comprising:

at least one central portion to which at least two side portions are fixed by hinges to allow for oscillation said central portion having hooking elements for its connection to a tool-holder connected to a rear part of a vehicle and at least one rake for the beating of snow, a side miller within each of the said side portions, a central miller within said central portion, wherein:

said side millers can be activated in rotation by at least one motor, and are connected to said central miller by at least a constant-velocity joint, and said hinges comprise axles which do not pass through the axles of said central millers and side millers.

2. A milling unit according to claim 1, wherein said hooking elements comprise at least two loops, each of which is supported by opposite ends of said central portion.

3. A milling unit according to claim 2, wherein hooking elements comprising at least a bar having, at its free end, handles to which at least one pin is fixed are fixed to said tool holder in said central portion along a transversal symmetry axle of said central portion.

4. A milling unit according to claim 1, wherein said central portion supports an oil-pressure control unit configured to activate hydraulic control cylinders of said milling unit.

5. A milling unit according to claim 1, wherein said rake has a toothed work surface and a forked hooking portion, which enfolds a tube integral with said central and side portions of said structure and is blocked in seatings.

6. A milling unit according to claim 1, wherein said hooking elements comprise a pair of handles protruding from the ends of said central portion each having a through hole into which a first bush, in which a spherical connection joint is fixed to a further handle integral with each of the said side portions, is inserted.

7. A milling unit according to claim 6, wherein said bushes are fitted with a collar aimed outside of the pair of said handles.

8. A milling unit according to claim 1, wherein said side millers comprise a toothed tube.

9. A milling unit according to claim 8, wherein said motors are integrally connected to other plates of said side portions, said motors activating a shaft in rotation upon which a second bush is coupled with a spherical bowl, the latter is placed in a seating fixed to a second plate which is fixed to the inside of said side miller partially covering an end of said motor and remaining at a distance to allow for oscillation of said side miller.

10. A milling unit according to claim 1, wherein adjacent ends of each of said side portions and of said central portion comprise an inner plate upon which at least one tube is inserted into said central miller, and at least one bearing to support a sleeve is inserted integral with a disk fixed to each of said side millers and to said central miller through a constant-velocity spherical joint.

11. A milling unit according to claim 10, wherein said tube is separated from said central miller and to said side millers.

12. A milling unit according to claim 10, wherein said spherical joint comprises rounded teeth and avoids undesired angular acceleration.

13. A milling unit according to claim 1, wherein a foldable shovel, which opens to increase the surface area to be beaten, is hinged to the two sides of each of said side structures.

* * * * *